US010173863B2

(12) United States Patent
Forsström et al.

(10) Patent No.: US 10,173,863 B2
(45) Date of Patent: Jan. 8, 2019

(54) DIVERTING PULLEY ADAPTER

(71) Applicant: KONE Corporation, Helsinki (FI)

(72) Inventors: Niko Forsström, Hyvinkää (FI); Tapani Talonen, Tervakoski (FI)

(73) Assignee: KONE CORPORATION, Helsinki (FI)

( * ) Notice: Subject to any disclaimer, the term of this patent is extended or adjusted under 35 U.S.C. 154(b) by 259 days.

(21) Appl. No.: 15/153,438

(22) Filed: May 12, 2016

(65) Prior Publication Data

US 2016/0257530 A1 Sep. 8, 2016

Related U.S. Application Data

(63) Continuation of application No. PCT/EP2014/074026, filed on Nov. 7, 2014.

(30) Foreign Application Priority Data

Nov. 13, 2013 (EP) ..... 13192775

(51) Int. Cl.

| | |
|---|---|
| ***B66B 15/00*** | (2006.01) |
| ***B66B 15/02*** | (2006.01) |
| ***B66B 19/00*** | (2006.01) |
| *B66B 15/04* | (2006.01) |

(52) U.S. Cl.

CPC ..... *B66B 15/02* (2013.01); *B66B 19/007* (2013.01); *B66B 15/04* (2013.01)

(58) Field of Classification Search

CPC ..... B66D 3/06; B66D 3/08; B66D 2700/026; B66B 15/02; B66B 15/04

USPC ..... 254/393–398

See application file for complete search history.

(56) References Cited

U.S. PATENT DOCUMENTS

| | | | | |
|---|---|---|---|---|
| 4,760,992 | A * | 8/1988 | Peppel | B63B 21/16 242/155 R |
| 5,149,059 | A * | 9/1992 | Monahan | B63B 21/10 254/394 |
| 5,513,724 | A | 5/1996 | De Jong | |
| 7,377,487 | B2 * | 5/2008 | Otten | B25H 1/0028 248/322 |

(Continued)

FOREIGN PATENT DOCUMENTS

| | | | |
|---|---|---|---|
| CN | 1094692 | A | 11/1994 |
| CN | 103237750 | A | 8/2013 |

(Continued)

*Primary Examiner* — Emmanuel M Marcelo

(74) *Attorney, Agent, or Firm* — Birch, Stewart, Kolasch & Birch, LLP

(57) ABSTRACT

A diverting pulley adapter is provided for converting an existing pulley, the adapter enabling a maintenance of an existing running path for diverting a suspension, like an elevator-rope or an elevator-belt, the adapter having a base with at least one fixing component for anchoring the adapter, at which base a set of pulleys is provided. The adapter includes a first deflection pulley being mounted rotatable on its rotation axis, and at least a further second deflection pulley being mounted rotatable on its rotation axis, wherein the rotation axes of the pulleys are interspaced, respectively. The positions of those pulleys forming the set of pulleys are adjustable in view of their fixation, respectively, and symmetrically in relation to the fixing component.

5 Claims, 2 Drawing Sheets

(56) References Cited

U.S. PATENT DOCUMENTS

| | | | | |
|---|---|---|---|---|
| 7,722,013 | B2 * | 5/2010 | Franzen | B66D 3/06 254/393 |
| 8,312,908 | B2 * | 11/2012 | Hinc | B29D 30/1635 156/394.1 |
| 8,684,336 | B1 * | 4/2014 | Akerman | E21B 17/07 254/337 |
| 8,863,906 | B2 * | 10/2014 | Mustalahti | B66B 7/06 187/251 |
| 2003/0159891 | A1 * | 8/2003 | Ach | B66B 11/008 187/266 |
| 2007/0045053 | A1 * | 3/2007 | Hashiguchi | B66B 7/021 187/408 |
| 2012/0090144 | A1 | 4/2012 | Leckman et al. | |

FOREIGN PATENT DOCUMENTS

| | | | |
|---|---|---|---|
| JP | 7-61744 | A | 3/1995 |
| JP | 11-228058 | A | 8/1999 |
| JP | 2002-80179 | A | 3/2002 |
| JP | 2004-338831 | A | 12/2004 |
| WO | WO 2010/086492 | A1 | 8/2010 |

* cited by examiner

Fig. 1
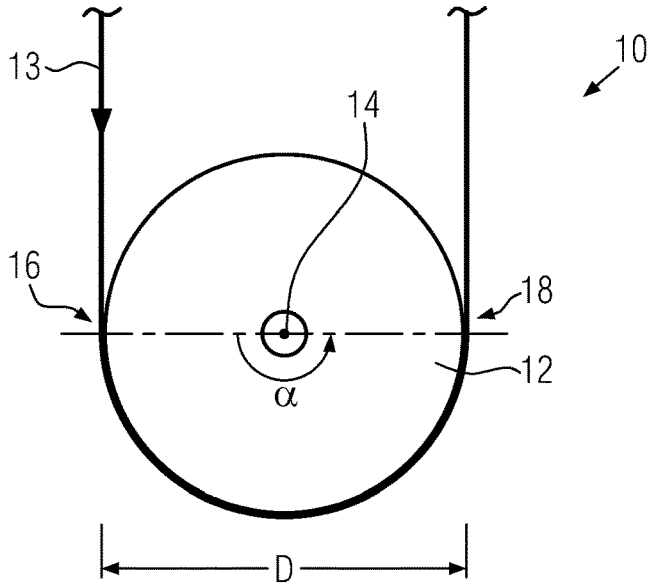
FIG. 1A - Prior Art
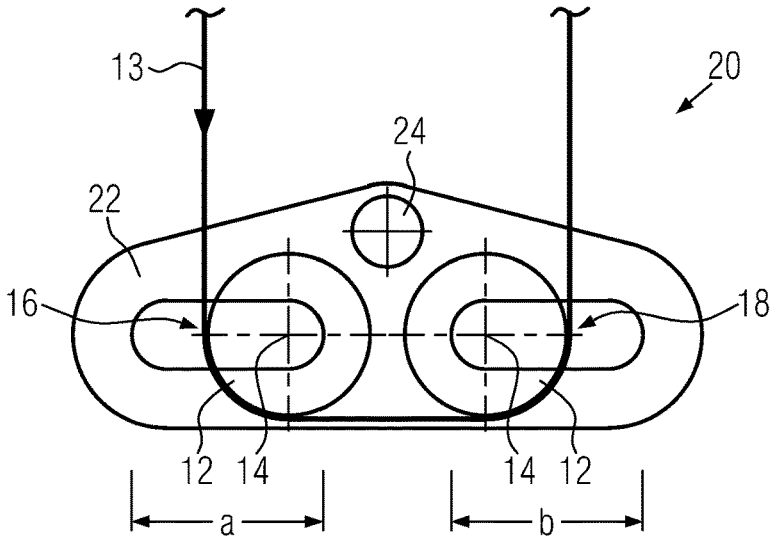
FIG. 1B

FIG. 2A - Prior Art

DIVERTING PULLEY ADAPTER

CROSS REFERENCE TO RELATED APPLICATIONS

This application is a Continuation of PCT International Application No. PCT/EP2014/074026, filed on Nov. 7, 2014, which claims priority under 35 U.S.C. 119(a) to patent application Ser. No. 13/192,775.8, filed in Europe on Nov. 13, 2013, all of which are hereby expressly incorporated by reference into the present application.

SUMMARY OF THE INVENTION

The invention relates to a diverting pulley assembly functioning as an adapter for converting or replacing an existing pulley to be able to divert a suspension means like an elevator-rope or an elevator-belt in its unchanged path. The invented device finds in particular preferred use for modernizing already installed elevator-systems, in which an elevator car and/or a counterweight is/are suspended by means of said suspension means.

In prior art technology of elevator-systems there are needed diverting pulleys to turn the running direction of the suspension means in-between its two ends to achieve higher suspension ratios. Taking for example a suspension ratio of 2:1, there are needed at least two diverting pulleys beside the traction sheave to realize such a lifting block. On this behalf the diverting pulleys are mounted in the elevator shaft or machine room as well as in connection with elevator components, e.g. on the elevator car and counterweight. A diverting pulley comprises a groove in which the chosen suspension means, i.e. the rope or the belt is running by rotating the pulley around its rotation axis. Normally, there is an angle of contact between the suspension means and the pulley of about 180°. However, this contact-angle can also be more or less. Anyway, the diameter of the pulley is a decisive parameter for the distance between the two touching-points of the suspension means, i.e. the one where the suspension means runs onto the pulley and the point where the suspension means leaves the same. In case of a contact angle of 180° this distance corresponds exactly to the diameter of the pulley.

In prior art pulleys are known for example from documents JP H07 61744 A or WO 2010/086492 A1 which are fixed on a trimmer beam extending along the roof of the cabin, wherein an adjustment of the horizontal distance between diverting pulleys is enabled.

The diameter of the pulley is not freely to be chosen but is dependent from the characteristics of the suspension means. Taking for example an elevator rope, the allowable bending stress to the rope dictates said pulley diameter. According to an internationally accepted practice a convenient ratio of $$(\text{diameter of the pulley}/\text{diameter of the rope}) \geq 40$$

has been established.

Although being not in the same ratio, a dependency is also relevant when using belts as the suspension means.

Both the position of the diverting pulleys and the diameter of the same do define the final position of the suspension means as running in the shaft, meaning the defined running path. Having once defined said running path the latter should not be changed by for example performing a maintenance work or when modernizing the elevator by implementing different suspension compounds. This is because any change of the running path interferes with the tension between the endings of the suspension means and such a tensioning change would also mean to apply a different force on other components which are in contact with the suspension means, i.e. the car, the counterweight or a traction sheave when being used.

If the suspension means of an existing elevator system is intended to be exchanged by a new one having different characteristics compared to the former one, it would actually be possible to use other pulleys which take into account the new characteristics of the converted suspension means. If, for example, a new elevator rope shall be used in an existing elevator-system which new rope has a smaller diameter than the existing rope, one then would be able to use pulleys with a smaller diameter. However, the rope drop-down line is then changed automatically when implementing a different diameter of a pulley since changing therewith the distance between the touching point of the rope at the incoming site and the respective leaving point of the rope from the pulley. Until now, there has not been realized a modernisation with a thin-rope-system for existing 2:1 elevators due to this problem. In belt technology the machinery and the hoisting are typically moved from the machine room to the shaft headroom when modernising the elevator with new systems. This causes costs.

By changing the position of the suspension means the problem will then also arise that the fixing-holes for the fixing points of the pulleys would not be in the right place for the new suspension means, i.e. the new ropes or the new belts. Known measures deal with an adaptation of said fixing points in the existing machine room by fixing for example an adapted bedplate to the headroom of the shaft. It is also difficult to enlarge the machine room slab-holes or to make additional ones. Beside this, the existing shaft structures need to be sufficiently strong for this purpose. The machine room floor strength however does often not meet this requirement for additional or bigger slab-holes between the existing ones. The latter requires strength calculations and reinforcement beams.

Further, the headroom safety space is decreased, leading to required additional access monitoring and safety arrangements. Additional, said measures mean a lot of costs and often an implementation of complicated brackets to fix the new construction. This in turn also means that the elevator is a longer time out of service as there is needed a lot of work within the elevator shaft.

The invention aims to disclose a new kind of pulley assembly in the form of a diverting pulley adapter resolving the above problems of prior art.

The invented diverting pulley adapter comes out by features as disclosed in claim 1. Convenient embodiments are disclosed in respective subclaims.

According to the invention, the diverting pulley adapter comprises a base with at least one fixing component for anchoring the adapter, at which base a set of pulleys is provided comprising a first deflection pulley being mounted rotatable on its rotation axis, and at least a further second deflection pulley being mounted rotatable on its rotation axis, wherein the rotation axes of the pulleys are interspaced to one another. By means of this concept the distance between the cords of the incoming and leaving suspension means as it runs around the pulley adapter can be set independently from the diameter of pulley(s). In prior-art-pulley-assemblies having a single pulley, said distance means the direct line between the radius end-points of the above cited contact angle, thus called in the following also direct-line-distance. It is also to be noted that while said contact angle means a 100%-contact between the pulley assembly and the suspension means when using a single pulley as known in prior art, said contact is interrupted when using multiple pulleys according to the invention.

Said distance between the cords of the incoming and leaving suspension means as it runs around the pulley adapter is defined inter alias by means of at least two interspaced pulleys forming a pulley-set of the pulley adapter which set of pulleys is arranged on the common base of the diverting pulley adapter. In other words: It is no longer solely the diameter of a diverting pulley itself but a further parameter is introduced, namely the position of at least two deflective pulleys relative to each other and/or to the base, which positions take part to define this distance between the cords, too. Preferably the used deflection pulleys do rotate in the same plane, i.e. the rotation axes of the pulleys are parallel, but they are spaced apart, which distance is to be measured in said plane.

The diverting pulley adapter of the invention aims a conversion, i.e. replacement of an existing pulley of an installed elevator system. The fixing component of the base is conveniently of that kind which is already used in existing diverting pulleys, i.e. a bearing hole through which a fixing bolt is to be passed. This makes it possible to anchor the inventive adapter in a pivotable manner around the fixing bolt.

When having a look to the existing pulley which is to be replaced, the installation of it has been realized at most by fixing the centre bolt within a bushing, which bolt bears the pulley-sheave in a rotational manner. Thus, the pulley-sheave is enabled to rotate around the fixing-bolt of the pulley, meaning that the rotation axis coincides with the axis of the fixing bolt. Therewith, the running path of the suspension means, i.e. the rope or belt has been defined i.a. in relation to said fixing point of the pulley guiding the suspension means around. In that one is now able by means of the inventive diverting pulley adapter to adjust the position of each diverting pulley of the set of pulleys and symmetrically in relation to the fixing component of the base, the adapter enables the maintenance of the already existing running path of a former elevator system by using the original fixation structure.

When using the word "symmetrically" it is meant a symmetry with respect to an imaginary line lying in a parallel plane of the base and passing through the fixing component, conveniently through the centre of the fixing component. In extreme situations said symmetry can also be a point symmetry in case either the possible fixing points of the pulleys and the fixing component itself do lie on a line.

According to an embodiment, the positioning and adjustment of the mounting position of at least one of the deflection pulleys relative to the base is implemented by providing a number of mounting holes in the base for fixing the respective pulley.

According to an advantageous embodiment the pulleys forming the set of pulleys are fixable within a single longhole being arranged in the base, wherein said longhole is arranged symmetrically with respect to the fixing component.

According to another advantageous embodiment each pulley of the set of pulleys is held in a respective longhole, which longholes are all arranged in the base and symmetrically with respect to the fixing component. Therewith, every pulley's position is selectable by moving it along its respective moving-path.

This adjustment and fixation of a pulley can be conveniently realised in a continuous fashion, in that for example longhole as an elongated mounting hole is provided in the base for fixing the pulley with a screw and screw-nut while being able to vary its position along this elongated moving-line.

Further, the longhole or the longholes can be curved. This can be realized in a manner passing symmetrically around the fixing component. However, it is also possible to pass away from the fixing component but being still symmetrically with respect to the fixing component. In case of curved longholes, the longholes can in an convenient embodiment be connected at one side so that one single longhole arises in which both diverting pulleys are fixable.

All in all a moving-line of a pulley can be designed in different ways:

i) in a simple way the line is a straight-line interconnecting the rotation axes of the pulleys; After having installed the inventive pulley adapter, in the simplest embodiment the imaginary line interconnecting the axles of the pulleys is perpendicular to the elevator shaft axis and therewith to the running path of the elevator car. If so, said line is then generally also perpendicular to the running path of the suspension means when running parallel to the elevator car or counterweight.

ii) another shape of the moving-line is a straight-line, on which the one rotation axis of one movable pulley rests but said line does not intersect the rotation line of the additional pulley. It is not a must that the moving-line along which a pulley is held movable, runs in coincidence with the imaginary connection between the rotation axes of the pulleys. The moving path of one of the pulleys can deviate from the imaginary connection line between the rotation axes of the pulleys. Then, the pulleys can for example be arranged in a kind above each other when seen in the running direction of the suspension means, so that it is not even the sum of the diameters of both pulleys contributing to the size of the above described direct-line-distance between the cords of the incoming and leaving suspension means as it runs around the pulley adapter.

iii) the moving line can be curvilinear, in a special form like a circular line.

It is also possible to fix both the pulleys on a common support-element which element is then to be mounted in one of said mounting holes of the base. This would mean that by changing the mounting hole for the support-element, both positions of the pulleys are simultaneously changed relative to the base.

In another embodiment there is a positioning means to change the mounting position of a deflection pulley (12) relative to the at least one additional pulley (12) for being able to vary the distance between the rotation axes of the pulleys, respectively.

By means of the above characteristics of the inventive diverting pulley adapter the latter serves conveniently for converting an existing single diverting pulley. This is especially then the case when an existing suspension means of an existing elevator system is exchanged by one having different attributes. For example, this can be when using a thinner rope than before, the diameter of a pulley can then be diminished accordingly. However, a reduction of said diameter would also mean to change the existing running path of the suspension means, whereas by means of the inventive diverting pulley adapter said running path can be maintained by adjusting the position(s) of the pulley(s) of the pulley adapter to one another accordingly. The same is true when for example modernizing an existing elevator by converting existing thick ropes of for example 8-20 mm to a belt-suspension-system.

The inventive diverting pulley adapter can be fixed either into existing diverting pulley fixing points, i.e. axles or into any kind of existing diverting pulley brackets or fixing components. Therewith, existing lifting points and rope drop lines as even slab-holes can be utilized for the inventive diverting pulley adapter. This means that existing constructive elements can be used under modernizing measures. This is true for elevator systems with a suspension ratio of 1:1 or 2:1 or higher.

The benefits as gained by the inventive pulley adapter are thus to aim an increased shaft headroom since an existing big diameter pulley is replaceable by the inventive diverting pulley adapter which is of smaller size. Further, the weight of the inventive diverting pulley adapter is less compared with the one which is to be exchanged.

BRIEF DESCRIPTION OF THE DRAWINGS

The invention is now described in further details with reference to the following drawings, in which FIG. 1A illustrates a prior art pulley assembly having a single pulley;

FIG. 1B illustrates a diverter pulley adapter installed on two pulleys;

DETAILED DESCRIPTION OF THE INVENTION

Figure 2:
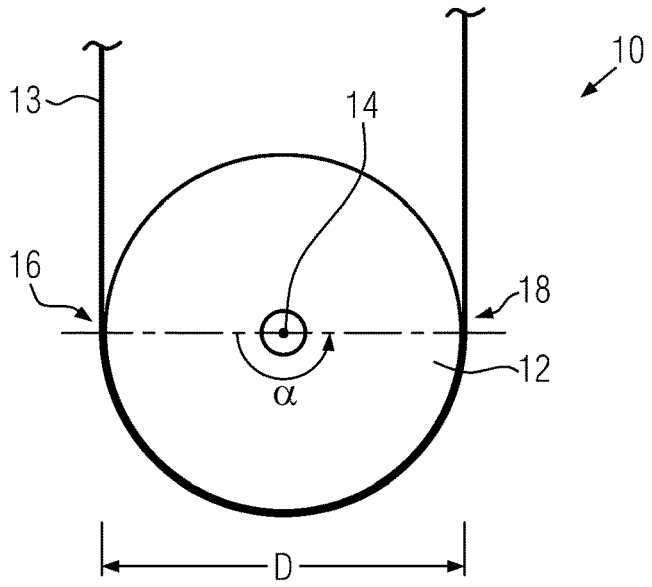
FIG. 2A illustrates a prior art pulley assembly having a single pulley.
FIG. 2B illustrates another example of the inventive diverting pulley adapter installed on two pulleys.

In FIG. 1A, a prior-art-pulley-assembly 10 is to be seen having a single pulley 12 rotating around a rotation axis 14. A suspension means 13 is running around the pulley 12 and forms a contact angle α of 180°. Said contact angle α is formed between two points, i.e. the touching-point 16 of the incoming suspension means and the point where the suspension means leaves the pulley, i.e. the leaving point 18—the terms "incoming" and "leaving" are of course dependent from the running direction of the suspension means which is assumed to be according to the arrow as shown but which naturally changes when operating the elevator. However, even when the running direction is turned, either said contact angle α and said distance D between the two points 16 and 18 remain unchanged.

In the examples shown in FIGS. 1A and 2A, the incoming path and outgoing leaving path of the suspension means are parallel by forming the constant distance D.

FIG. 1B illustrates the inventive diverting pulley adapter 20, comprising a base 22 having a fixing component 24 to install the diverting pulley adapter for example at an existing machine room fixing point. Mounted to the base 22 are in this example two pulleys 12 each having a smaller diameter compared with the prior pulley of the existing pulley assembly 10, respectively. Each pulley 12 is mounted in a longhole, respectively, which longhole defines a possible moving path for the respective pulley. Each pulley is further rotating around its own rotation axis 14. Each pulley 12 can be moved along a connection-line of the rotation axes 14 being defined by the longhole. For example, the left pulley as shown in FIG. 1B can be moved along an adjusting distance a, while the right hand pulley 12 can be moved along an adjusting distance b. By means of these amounts a and b for adjusting the distance between the rotation axes of both the pulleys, the distance D is adjustable, too, and can be chosen such that it corresponds for example to the distance D of an existing pulley which is to be replaced.

Further, both the positions of the pulleys 12 relative to the base 22 can be set by the invention, so that an existing running path of the suspension means can be maintained or adapted by choosing the variable positions.

As can be seen from FIG. 1B showing the inventive adapter, the moving paths of both pulleys 12 forming the set of pulleys are arranged symmetrically in relation to the fixing component 24 of the base 22. Said symmetry is a line symmetry which line passes through the mounting hole of the base and being in a plane which is parallel to the base plate, i.e. meaning therewith the drawing line.

Figure 2B:
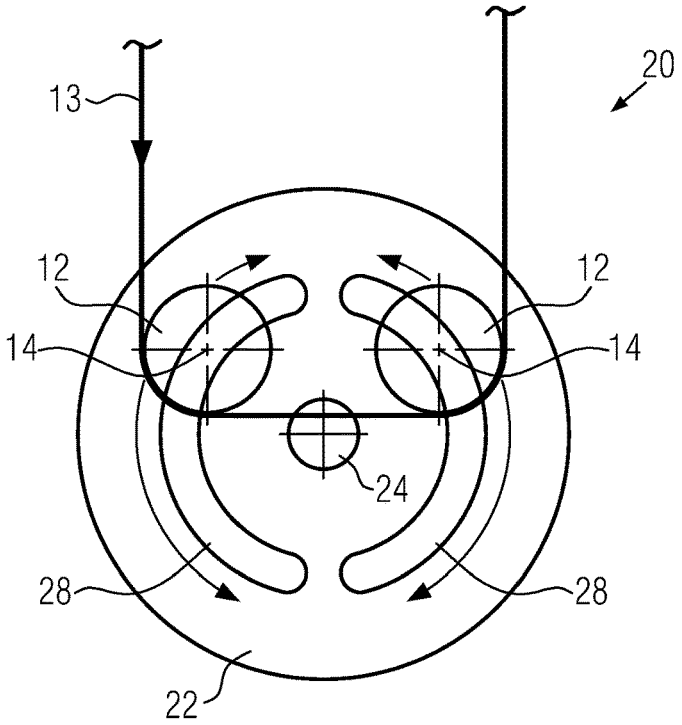

When turning to FIG. 2B now, the longholes are both curved and defining therewith a curved moving line of each pulley, respectively. Here again, the longholes are arranged symmetrically with respect to the fixing component of the base. This construction realizes that the distance between the fixing point of the base and a pulley can be maintained constant while at the same time rendering the distance between the pulleys themselves forming the set of pulleys.

It is to be noted that in case of curved longholes, the longholes can be connected at one side so that one single longhole arises in which both diverting pulleys are fixable.

It is to be noted, that both embodiments as shown in FIG. 1B and FIG. 2B can be combined so that each position of any pulley 12 relative to the base 22 is adjustable in a free way so that the running path of the suspension means can be chosen accordingly. Further, although in the present drawings an example of the inventive diverting pulley adapter is shown with two pulleys, the invention is not restricted to said number but can comprise even more than two pulleys. In a best mode then, all the pulleys being encompassed by the diverting pulley adapter are adjustable along their respective moving paths.

REFERENCE NUMBERS

10 pulley assembly
12 pulley
13 suspension means
14 rotation axis
16 touching point of incoming suspension means
18 leaving point of the suspension means
α rotation angle
20 diverting pulley adapter
22 base
24 fixing component
a adjusting distance of the first pulley
b adjusting distance of the second pulley
D distance
26 adjusting path of pulley
28 longhole

The invention claimed is:

1. A diverting pulley adapter for converting an existing pulley, the adapter enabling a maintenance of an existing running path for diverting a suspension, the diverting pulley adapter comprising:

a base with a fixing component for anchoring the diverting pulley adapter;

a set of pulleys provided at the base, the set of pulleys comprising:

a first deflection pulley mounted rotatable on a rotation axis thereof; and at least a further second deflection pulley mounted rotatable on a rotation axis thereof, wherein the rotation axes of the first pulley and the at least a further second pulley are spaced from one another, wherein the positions of the pulleys forming the set of pulleys are adjustable in view of their fixation, respectively, and symmetrically in relation to the fixing component, and wherein each pulley of the set of pulleys is held in a respective longhole, which longholes are all arranged in the base and symmetrically with respect to the fixing component.

2. The diverting pulley adapter according to claim 1, wherein the longhole/longholes is/are curved.

3. The diverting pulley adapter according to claim 1, wherein the position of the pulleys are implemented such that its mounting position is continuously adjustable.

4. The diverting pulley adapter according to claim 1, wherein the suspension is one of an elevator-rope and an elevator-belt.

5. The diverting pulley adapter according to claim 3, wherein the longhole/longholes is/are curved.

* * * * *